United States Patent [19]

Platti

[11] Patent Number: 5,052,599

[45] Date of Patent: Oct. 1, 1991

[54] GARMENT HANGER WITH ADJUSTABLE HOOK

[76] Inventor: Rita J. Platti, 8041 Mariners Dr. - Apt. #3801, Stockton, Calif. 95209

[21] Appl. No.: 395,087

[22] Filed: Aug. 17, 1989

[51] Int. Cl.[5] ..... A47G 25/40; A47G 25/14

[52] U.S. Cl. ..... 223/89; 223/DIG. 4; 223/85; 223/94

[58] Field of Search ..... 223/85, 88, 89, 94, 223/92, 95, 98, DIG. 4; 248/340, 304, 327

[56] References Cited

U.S. PATENT DOCUMENTS

| | | | |
|---|---|---|---|
| 695,924 | 3/1902 | Grotenhuis | 223/85 |
| 1,049,867 | 6/1912 | Kalina | 223/89 |
| 1,114,294 | 10/1914 | Routstone | 223/89 |
| 1,374,024 | 4/1921 | Morton | 223/89 |
| 1,804,314 | 5/1931 | Brun | 223/95 |
| 2,360,119 | 10/1944 | Gallagher | 223/89 |
| 2,446,312 | 8/1948 | Usina | 223/94 |
| 2,472,262 | 6/1949 | Mullen | 223/89 |
| 2,495,335 | 1/1950 | Lee et al. | 223/92 |
| 2,591,163 | 4/1952 | Kivett | 223/98 |
| 2,656,955 | 10/1953 | Harrell | 223/98 |
| 2,738,908 | 3/1956 | White | 223/89 |
| 2,817,470 | 12/1957 | Simon | 223/89 |
| 2,842,329 | 7/1958 | Friedman et al. | 248/340 |
| 3,227,334 | 1/1966 | Samuelson | 223/85 |
| 3,474,943 | 10/1969 | McBain et al. | 223/95 |
| 3,602,408 | 12/1969 | Gaydos | 223/98 |
| 4,586,524 | 5/1986 | Smith | 223/89 |
| 4,669,642 | 6/1987 | Nicholas | 223/94 |
| 4,739,912 | 4/1988 | Klawieter et al. | 223/DIG. 4 |

FOREIGN PATENT DOCUMENTS

| | | | |
|---|---|---|---|
| 398955 | 3/1966 | Switzerland | 223/85 |

*Primary Examiner*—Werner H. Schroeder
*Assistant Examiner*—Bibhu Mohanty

[57] ABSTRACT

The adjustable clothes hanger includes two divergent shoulder portions connected to a crossbar at their ends thereof to be assembled with a pair of generally elongated tubular-shaped movable parts with an open channel at a bottom wherein the open channels of each said movable parts are closed at the inner ends thereof to provide a stopping device as well as strength and stability. The movable parts slide manually. The slidable fittings are loose enough to slide easily, yet tight enough to secure desired position. The shoulder width of the hanger is thereby changed by the expansion or contraction of the movable parts. The hanger thus accommodates a variety of garment sizes. The adjustable principle can also be applied to a singular set of divergent shoulder portions with tubular-shaped movable parts. The adjustable principle can also be applied to two or three cross bar hangers, wherein U-shaped extensions provide for expansion and contraction of the hanger width. Widened shoulder sections on the movable parts are used to support a garment better. Adjustable hooks are generally telescopic and thereby vary the height of the hanger. The adjustable clothes hanger is simple and practical designed to adjust so as to hold garments properly and securely.

1 Claim, 5 Drawing Sheets

GARMENT HANGER WITH ADJUSTABLE HOOK

BACKGROUND OF THE INVENTION

1) Field of the Invention

This invention pertains to garment hanging apparatus, and particularly to a hanger with adjustable shoulders to accommodate various garment sizes, and more particularly to a variety of movable shoulder designs such as tubular-shaped, rail-shaped, other male-female fittings for slidable parts, also including such variations of design such as plural rods, adjustable hook, singular rod, and an attachable shoulder to be mounted on a hanger and then adjusted, and also a wider arced shoulder portion to fit the garment better.

2) Description of the Prior Art

A reoccurring situation associated with the hanging of garments is the difference between the hanger size and the garment size. As a consequence the garment itself often ends up with indentations and in some cases needs re-ironing.

Thus a need exists for a simple, sturdy means of adjusting shoulder width to suit a variety of garment sizes. The designs of the prior arts could be improved upon in either stability, simplicity, shoulder fittings, and in general overall efficiency and variety of design and detailed features.

Prior arts references cited; U.S. Pat. No. 3,602,408, Aug. 31, 1971, Gaydos, 223–98.

SUMMARY OF THE INVENTION

In accordance with the present invention, adjustable parts are mounted on or made part of a garment hanger and variations of slidable portions are detailed. Said movable parts are fitted on the shoulders of the hanger with the movable part being a tubular-shaped apparatus sliding on the hanger shoulder, fitted and made of such material so that movement would be easy yet tight enough to secure desired position. If said tubular part is made as part of the hanger, that portion nearest the center of the hanger would be a closed circular tubing, thereby adding stability to the movable part. The rest of the tubular-shaped moving part has an open channel along the bottom, thereby allowing for expansion and contraction on the shoulder portions.

The singular rod and plural rod adjustable hanger design are slidable by expansion and contraction of generally tubular-shaped fittings on the shoulder portions of the hanger. The upper portion of the hanger comprising two divergent rods and if a plural rod hanger, the lower portion or portions comprising a rod or rods, are then fitted with generally tubular-shaped movable parts, loosely enough to allow sliding yet tight enough to secure desired position.

The scope of this invention is intended to include the wide variety of fittings, male and female, that would allow for the slidable action of any of the above mentioned adjustable hangers. The shoulder portions could, for example, assume a rail-type shape, then the slidable portions simply fitted into the rails, allowing slidability. Therefor the movable parts need not be confined to the generally tubular shape to be movable in a simple manner.

The other features of this invention include such optional items as an adjustable hook, stopping devices, and wide-arced shoulder sections to improve the efficiency of the adjustable hanger. The adjustable hook is a rod to be pulled up and down in a tubular-shaped projection at the top of the hanger. The stopping device of this hook is generally similar to the other stopping devices of this invention, namely, the extremity of the tubular shaped part is slightly contracted in diameter while the extremity of the rod is slightly expanded in diameter.

The wide-arced shoulder sections are simply a widening of the movable portions of the adjustable hanger, forming a wider shoulder area to support the garment shoulder. This does not alter the structure of any of the designs of the adjustable hanger, just widens the top.

FIG. **11*a*** is an isometric view of an optional stopping device showing generally the structure of the rods relative to the movable parts.

Figure 12:
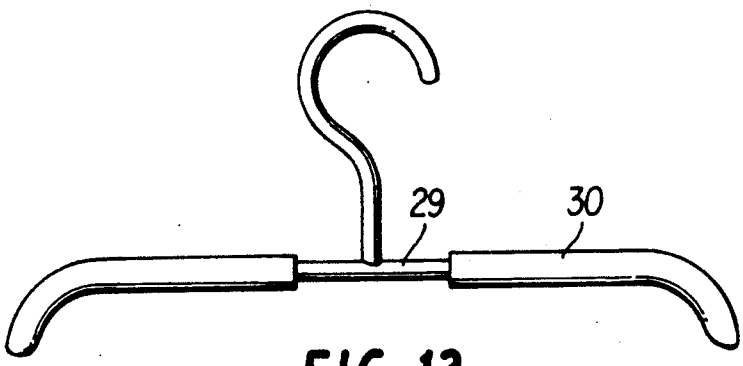

FIG. 12 is a front elevation view of the adjustable tubular hanger in closed position.

Figure 13:
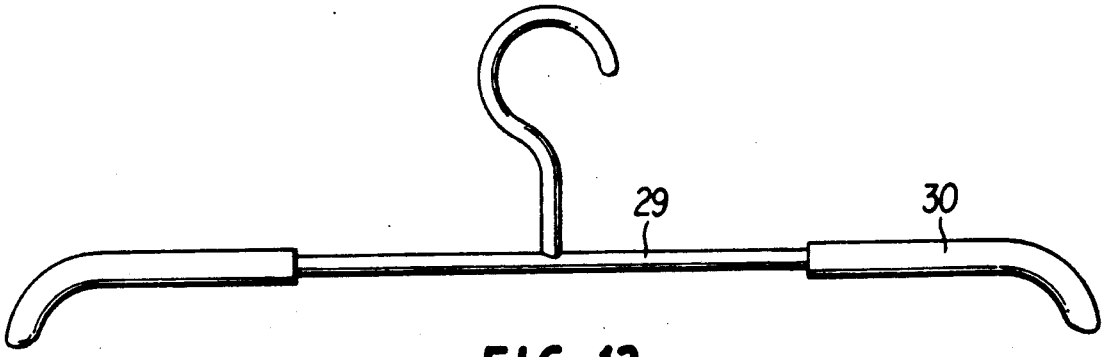

FIG. 13 is a front elevation view of the adjustable tubular hanger in open position.

FIG. **13*a*** is a sectional view showing the structure of the hanger shoulder portions relative to the tubular-shaped movable parts.

FIG. **13*b*** is an isometric view of an optional stopping device showing generally the structure of the shoulder portions relative to the movable parts at the stopping point.

FIG. 14A, 14B, 14C, 15A, 15B, 15C, 16A, 16B, 16C, 17A, 17B, 17C are all sectional views taken generally showing A—A the movable portion of the hanger relative to the shoulder closer to the center-line of the hanger; B—B showing the outer portion of the movable part relative to shoulder; C—C showing the movable part by itself.

Figure 18:
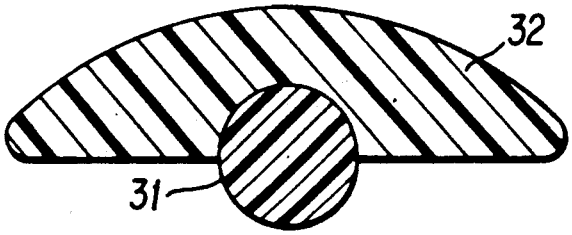

FIG. 18 is a sectional view taken generally showing the relative widening of the movable shoulder part relative to the shoulder portion toward the outer portion of the hanger.

Figure 19:
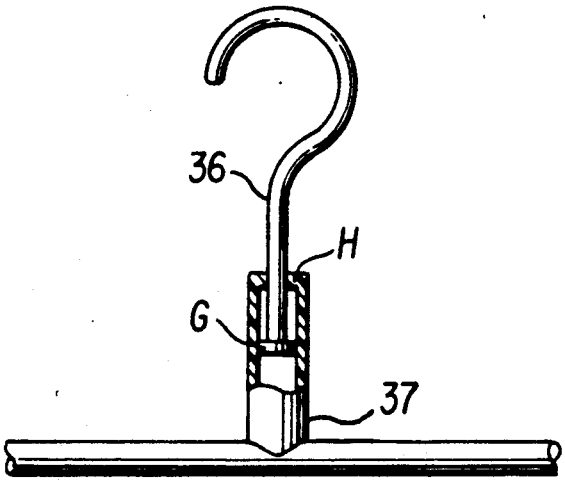

FIG. 19 is a front elevation view of the adjustable hook in partially lifted position.

Figure 20:
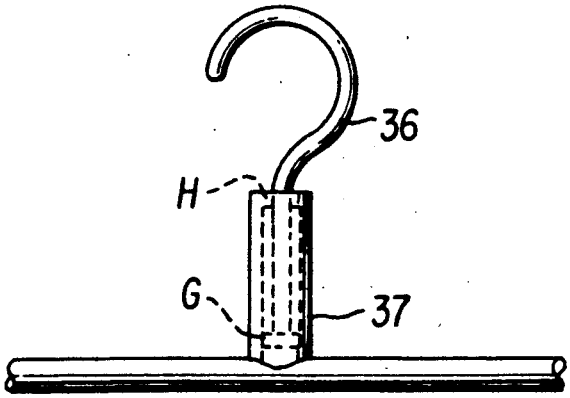

FIG. 20 is a front elevation view of the adjustable hook in closed position.

Although the disclosure is detailed and exact to enable those skilled in the field to manufacture this invention, the physical embodiments herein disclosed merely exemplify the invention, which may be embodied in other specific structure. The scope of the invention is defined in the claims appended hereto:

DESCRIPTION OF THE PREFERRED EMBODIMENT

Figure 1:
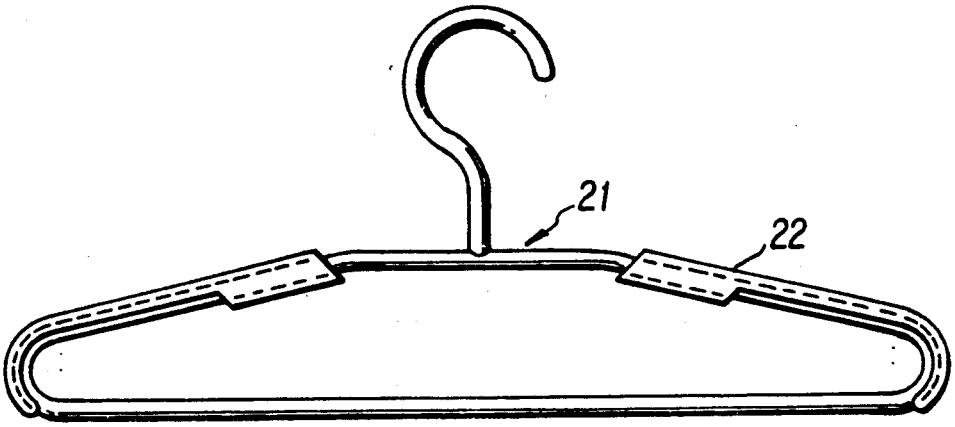
FIG. 1 is a front elevation view of the hanger with the stabilizer adjustable shoulders in closed position.

Referring to FIG. 1, a hanger 21 is illustrated and shown with the inclusion of this invention, the stabilizer adjustable shoulders 22. Said parts 22 are generally elongated tubularshaped movable parts with an open channel at a bottom, wherein the open channels of each said movable parts are closed at the inner ends thereof to provide stability at any position.

Figure 2:
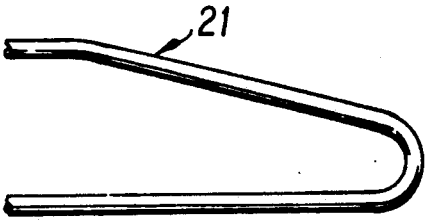
FIG. 2 is a front elevation view of a part of the hanger without the stabilizer adjustable shoulder.

Referring to FIG. 2, a part of the hanger shoulder 21 without the stabilizer adjustable shoulder is shown.

Figure 3:
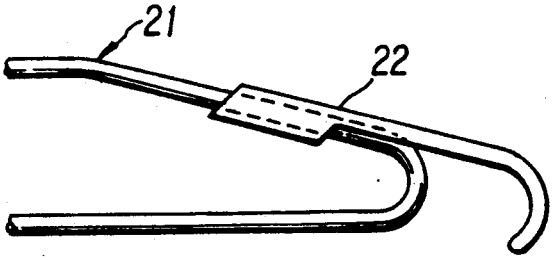
FIG. 3 is a front elevation view of part of the hanger with the stabilizer adjustable shoulder partially extended.

Referring ot FIG. 3, a part of the hanger shoulder 21 is shown with the stabilizer adjustable shoulder 22 in partially opened position.

Figure 4:
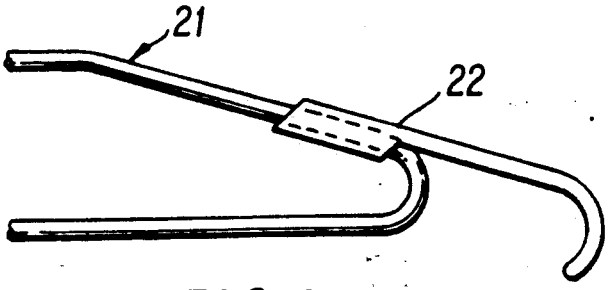
FIG. 4 is a front elevation view of part of the hanger with the stabilizer adjustable shoulder fully extended and in stopped position.

Referring to FIG. 4, a part of the hanger shoulder 21 is shown with the stabilizer adjustable shoulder 22 fully extended and illustrating the stopping point.

Figure 5:
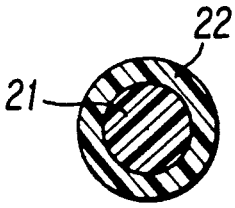
FIG. 5 is a sectional view taken generally closer to the centerline of the hanger, showing the structure of the hanger relative to the stabilizer adjustable part.

Referring to FIG. 5, this generally illustrates the structure of the hanger shoulder 21 relative to the stabilizer movable shoulder 22 closer to the center-line of the hanger.

Figure 6:
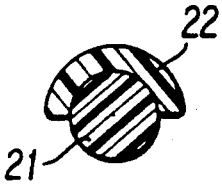
FIG. 6 is a sectional view taken generally further away from the center-line of the hanger and showing the structure of the hanger relative to the stabilizer adjustable part.

Referring to FIG. 6, this generally illustrates the structure of the hanger shoulder 21 relative to the stabilizer movable shoulder 22 further away from the center-line of the hanger.

Figure 7:
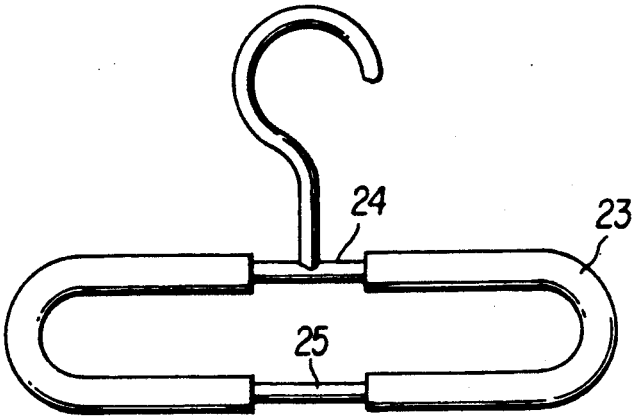
FIG. 7 is a front elevation view of an adjustable double-rod hanger in closed position.

Referring to FIG. 7, a plural-rod hanger is illustrated and shown with its inside rods, upper rod referred to as 24 and lower rod as 25. Part 23 is a U-shaped tubular movable part, constructed so that its inner dimension allows it to slide onto said parts 24 and 25. The fitting of said parts are so that said 23 will be allowed to be pulled in and out easily, yet tightly enough to secure desired position.

Figure 8:
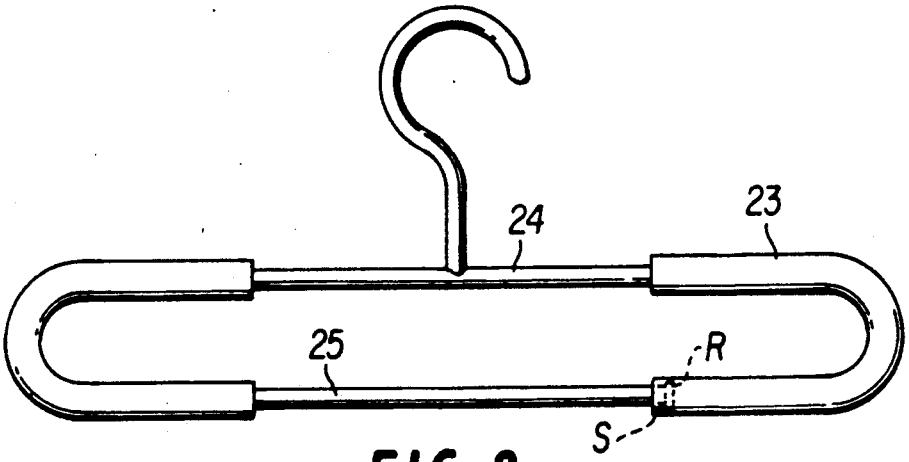
FIG. 8 is a front elevation view of the double-rod hanger in open position.
Figure 9:
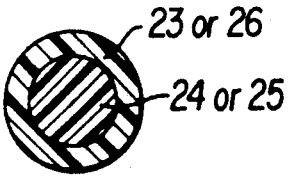
FIG. 9 is a sectional view taken generally where the movable tubular-shaped parts move along the inside rods showing the structure of these parts relative to each other.

FIG. 7 illustrates the closed position. FIG. 8 illustrates the expanded position. FIG. 9 is a cross-section taken generally where movable parts 23 slide along upper and lower rods 24 and 25, indicating their relative general fitting.

Figure 10:
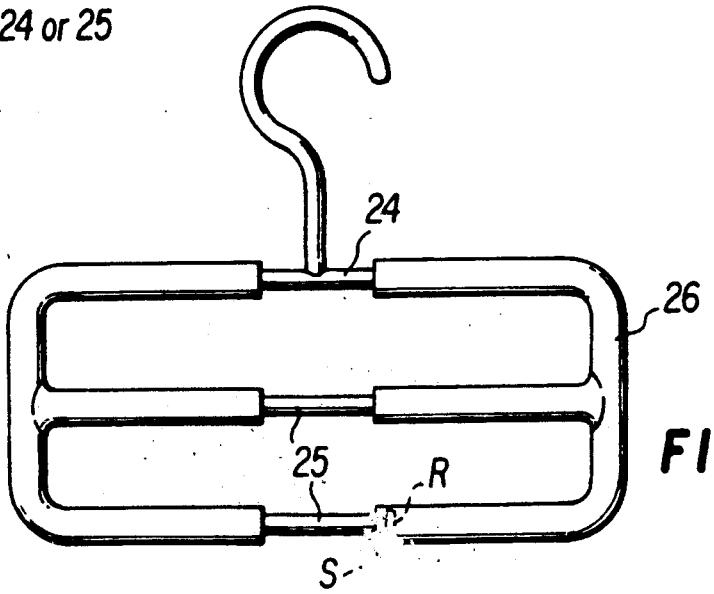
FIG. 10 is a front elevation view of a plural-rod adjustable hanger in closed position.

Referring to FIG. 10, this illustrates the same general structure and relative function of the upper rod 24 and the lower rods 25 to the movable parts 26. Said parts 26 assume the same relative function as part 23 in FIG. 7 and FIG. 8.

Using two rods in FIG. 7 and FIG. 8, then illustrating three rods in FIG. 10, is a further means to exemplify that plural-rods could then be understood to continue adding other rods.

Figure 11:
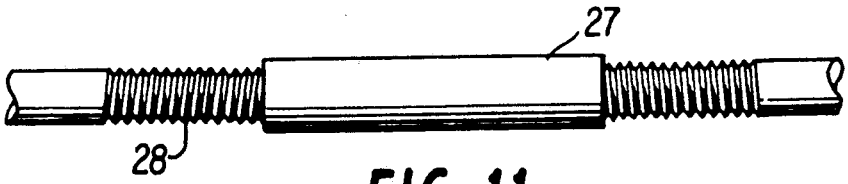
FIG. 11 is a front elevation view of an optional threaded rod taken generally where the rod joins the outside parts, showing the relative structure between the rod and the movable parts.

Referring to FIG. 11, this illustrates an option detail which could be put in the center of one of the lower rods 25. This would be generally wherein the center of part 25 has left and right hand thread portions in the center thereof and a complimentary thread sleeve turnable to adjust the extensions of said tubular parts.

Figure 11A:
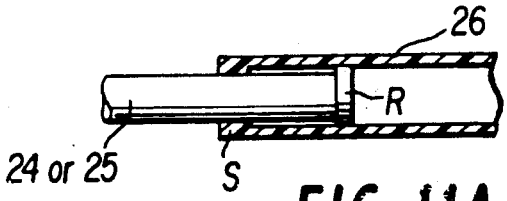

Referring to FIG. 11*a*, this illustrates the extremities of the rods 24 and 25 having slight increase in diameter and the inside ends of the movable tubular parts having a slight decrease in diameter. This fitting detail would be such that the tubular parts 23 in FIG. 7 and FIG. 8 and parts 26 in FIG. 10, would thereby not be disengaged from the rods 24 and 25.

Referring to FIG. 12, a hanger is illustrated and shown with the inclusion of the invention, the adjustable tubularshaped shoulders 30. Said parts 30 are generally elongated tubular-shaped movable parts in pairs, to be symetrically placed one on each of the divergent should rods 29. In FIG. 12 the movable parts 30 are in closed position.

Referring to FIG. 13, the adjustable tubular-shaped movable parts 30 have been extended to open position, thereby showing more of the divergent shoulder parts 29.

Figure 13A:
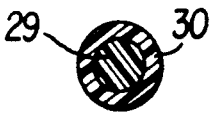

Referring to FIG. 13*a*, this generally illustrates the structure of the divergent shoulder parts 29 relative to the movable tubular-shaped parts 30.

Figure 13B:
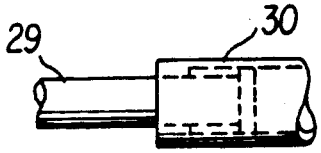
Figure 14A:
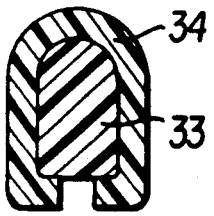
Figure 14B:
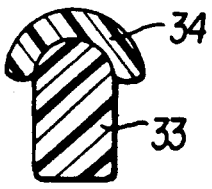
Figure 14C:
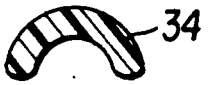
Figure 15A:
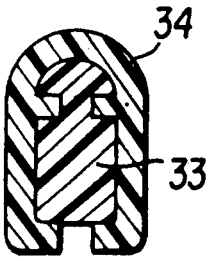
Figure 15B:
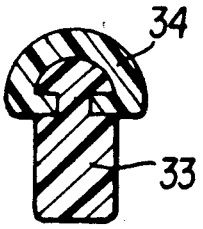
Figure 15C:
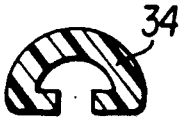
Figure 16A:
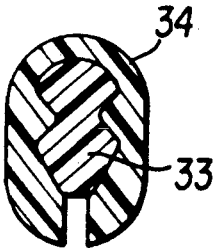
Figure 16B:
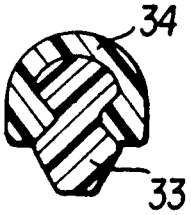
Figure 16C:
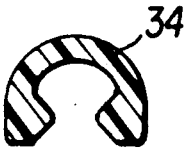
Figure 17A:
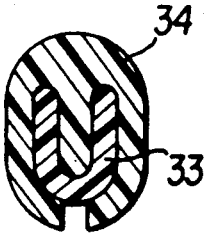
Figure 17B:
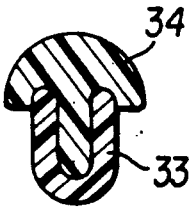
Figure 17C:
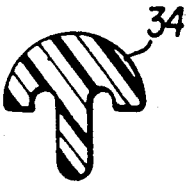

Referring to FIG. 13*b*, this illustrates the extremity of the divergent shoulder part 29 with a slight increase in diameter and the inside ends of the tubular-shaped parts 30 with a slight decrease in diameter. This optional fitting detail provides a stopping device so that the parts do not separate.

Referring to FIGS. 14A, 14B, 14C, 15A, 15B, 15C, 16A, 16B, 16C, 17A, 17B, 17C, these all illustrate examples of just a few of the male/female fittings possible for slidable shoulder action. The "A" figures show the slidable part being stabilized more securely toward the center of the hanger. The "B" figures show the slidable part more toward the outer part of the hanger. The "C" figures show the slidable parts away from the divergent shoulders of the hanger. In all these figures, parts 33 refer to the divergent shoulder parts of the hanger, while parts 34 refer to the movable parts of the hanger.

Referring to FIG. 18, this illustrates the section of the divergent shoulder 31 relative to the adjustable part 32 viewed about in the middle of the movable part in closed position. This shows a widening of the adjustable part 32 to according to the needs of garment size. Also these movable parts may be rotated forward or backward for further adjustment. Referring to FIG. 19, this shows an adjustable telescopic-type hanger hook in partially extended position. Part 37 is the center portion of the hanger generally tubular-shaped. Part 36 is rod-shaped curved on the top to form a hook. At point H, the top of part 37, the diameter is slightly decreased. At point G, the bottom of part 36, the diameter is slightly increased. This acts as a stopping device to prevent separation of the parts.

Referring to FIG. 20, this shows the same parts 36 and 37, but with part 36 in a down position.

I claim:

1. In combination an adjustable hook and a garment hanger, said garment hanger having an upper tube extension with an inner diameter, said adjustable hook including at least two ends, one of said ends having a thickened portion somewhat larger than the inner diameter of said tube portion, whereby said hook member is adjustable by frictional slidable contact of said thickened portion within said tube member.

* * * * *